US008878729B2

(12) United States Patent
Popugaev et al.

(10) Patent No.: US 8,878,729 B2
(45) Date of Patent: Nov. 4, 2014

(54) ELECTRIC CONDUCTIVE TRACE

(75) Inventors: Alexander Popugaev, Erlangen (DE); Rainer Wansch, Baiersdorf (DE); Lars Weisgerber, Neugersdorf (DE); Bernhart Pelger-Alzner, Erlangen (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 199 days.

(21) Appl. No.: 13/441,433

(22) Filed: Apr. 6, 2012

(65) Prior Publication Data

US 2012/0306701 A1 Dec. 6, 2012

(30) Foreign Application Priority Data

Apr. 8, 2011 (DE) ..... 10 2011 007 058

(51) Int. Cl.
*H01Q 1/36* (2006.01)

(52) U.S. Cl.
CPC ..... *H01Q 1/36* (2013.01)
USPC ..... 343/700 MS; 343/702

(58) Field of Classification Search
CPC ..... H01Q 1/38; H01B 5/00
USPC ..... 343/702, 700 MS
See application file for complete search history.

(56) References Cited

U.S. PATENT DOCUMENTS

| | | | | |
|---|---|---|---|---|
| 6,452,553 | B1 | 9/2002 | Cohen | |
| 6,476,766 | B1 | 11/2002 | Cohen | |
| 2007/0241973 | A1 | 10/2007 | Cho et al. | |
| 2008/0062049 | A1* | 3/2008 | Soler Castany et al. | 343/702 |
| 2008/0084352 | A1 | 4/2008 | Piskun | |
| 2010/0141548 | A1* | 6/2010 | Quintero Illera et al. | 343/848 |
| 2010/0177001 | A1 | 7/2010 | Alexopoulos et al. | |
| 2011/0177839 | A1 | 7/2011 | Baliarda et al. | |
| 2011/0273349 | A1* | 11/2011 | McQuaid et al. | 343/767 |
| 2012/0212385 | A1 | 8/2012 | Baliarda et al. | |

FOREIGN PATENT DOCUMENTS

| | | |
|---|---|---|
| DE | 60022096 | 6/2006 |
| DE | 102006038402 | 10/2007 |
| EP | 1699110 | 9/2006 |
| EP | 1912280 | 4/2008 |

OTHER PUBLICATIONS

"FEKO Quarterly", FEKO Quarterly, Sep. 2007, 4 pages.

Ghali, et al., "Miniaturized Fractal Rat-Race, Branch-Line, and Coupled-Line Hybrids", Ghali, et al., Miniaturized Fractal Rat-Race, Branch-Line, and Coupled-Line Hybrids, IEEE Transactions on Microwave Theory and Techniques, vol. 52, No. 11, Nov. 2004, pp. 2513-2520.

Sagan, H., "Space-Filling Curves", Sagan, H., Space-Filling Curves, Chapter 3, Springer Verlag 1994, pp. 31-47.

FEKO Quarterly, Sep. 2007.

(Continued)

*Primary Examiner* — Hoanganh Le

(74) *Attorney, Agent, or Firm* — Michael A. Glenn; Perkins Coie LLP

(57) ABSTRACT

An electric conductive trace includes an arch-shaped variation of a shape of at least a portion of a fractal of at least a second iteration. The portion of the fractal is larger than double of a first iteration of the fractal. The shape varied to be arch-shaped for changes of direction includes a curve radius larger than a predefined minimum curve radius.

10 Claims, 17 Drawing Sheets

(56) References Cited

OTHER PUBLICATIONS

Ghali, et al., Miniaturized Fractal Rat-Race, Branch-Line, and Coupled-Line Hybrids, IEEE Transactions on Microwave Theory and Techniques, vol. 52, No. 11, Nov. 2004.

Popugaev, et al., A Novel Miniaturized Technique in Microstrip Feed Network Design, 3rd European Conference on Antennas and Propagation (EuCAP 2009), Mar. 23-27, 2009, Berlin, Germany, pp. 2309-2313.

Sagan, H., Space-Filling Curves, Springer Verlag 1994.

* cited by examiner

ELECTRIC CONDUCTIVE TRACE

CROSS-REFERENCE TO RELATED APPLICATIONS

This application claims priority from German Patent Application No. 102011007058.3-34, which was filed on Apr. 8, 2011 and is incorporated herein in its entirety by reference.

Embodiments in accordance with the invention relate to an electric conductive trace and its application as an antenna or line or in a distributed circuit.

BACKGROUND OF THE INVENTION

Antennas having many differently shaped conductive traces have been known. For example, U.S. Pat. No. 6,476,766 B1 shows a known fractal antenna and a fractal circuit using a classical fractal structure. Such a fractal antenna is shown in FIG. 2. Another example of a rat-race hybrid (hybrid coupler) as a Moore fractal in the second iteration according to Ghali, H.; Moselhy, T. A. "Miniaturized Fractal Rat-Race, Branch-Line and Coupled-Line Hybrids", IEEE Transactions on Microwave Theory and Techniques, Vol. 52, No. 11, November 2004, pp. 2513-2520" is shown in FIG. 3.

Antenna structures in US 2010/0177001 A1 are similar. They represent modified polygon-shaped Polya curves, as is depicted, e.g., in FIG. 6 in the second to sixth iterations (n=2-6). This type of known antennas has the disadvantage that strong reflections may arise at the corners and bends in the radio-frequency range (RF range). By using such curves, delay lines may be miniaturized, for example.

SUMMARY

According to an embodiment, an electric conductive trace may have an arch-shaped variation of a shape of at least a portion of a fractal of at least a second iteration, the portion of the fractal being larger than double of a first iteration of the fractal, the shape varied to be arch-shaped having, for changes of direction, a curve radius larger than a predefined minimum curve radius.

According to another embodiment, an antenna, line or distributed circuit may have an electric conductive trace which may have: an arch-shaped variation of a shape of at least a portion of a fractal of at least a second iteration, the portion of the fractal being larger than double of a first iteration of the fractal, the shape varied to be arch-shaped having, for changes of direction, a curve radius larger than a predefined minimum curve radius.

An embodiment in accordance with the invention provides an electric conductive trace comprising an arch-shaped variation of a shape of at least a portion of a fractal of at least a second iteration. The portion of the fractal is larger than double of a first iteration of the fractal. The shape varied to be arch-shaped comprises, for changes of direction, a curve radius larger than a predefined minimum curve radius.

Embodiments in accordance with the invention are based on the core idea of using electric conductive traces having the shape (at least of a portion) of a fractal, the electric conductive trace comprising arch-shaped pieces rather than corners. In this manner, on the one hand, conductive traces of long lengths may be realized in a very space-saving manner by utilizing fractal-shaped conductive traces. On the other hand, the reflections and losses in the electric conductive trace may be clearly reduced, due to the arch-shaped variation (of the corners of the fractal) when RF signals (radio-frequency signals, e.g. larger than 1, 10, 100 or 1000 MHz) are used.

In some embodiments in accordance with the invention, a Peano curve or a box fractal is used as the formative fractal.

In further embodiments in accordance with the invention, the shape varied to have the shape of an arch fits onto a raster of ring-shaped segments arranged at a distance of their average diameter. By using such a raster, the electric conductive trace may be systematically given its shape without falling short of the predefined minimum curve radius.

BRIEF DESCRIPTION OF THE DRAWINGS

Embodiments of the present invention will be detailed subsequently referring to the appended drawings, in which.

DETAILED DESCRIPTION OF THE INVENTION

Figure 1A:
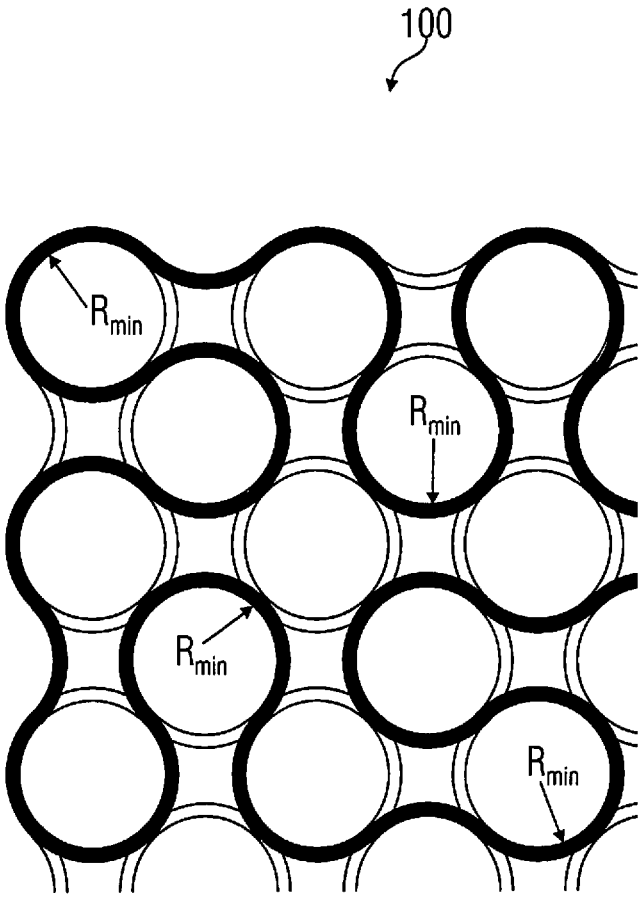
FIG. 1*a* shows an electric conductive trace.

In the following, identical reference numerals are sometimes used for objects and functional units having identical or similar functional properties. In addition, optional features of the different embodiments may be mutually combinable or mutually exchangeable.

FIG. 1*a* shows a schematic representation of an electric conductive trace 100 in accordance with an embodiment of the invention. The electric conductive trace 100 at least partly comprises an arch-shaped variation of a shape of at least a portion of a fractal of at least a second iteration. The portion of the fractal is larger than double of a first iteration of the fractal. The shape varied to be arch-shaped comprises a larger curve radius for changes of direction than a predefined minimum curve radius $R_{min}$.

Figure 1B:
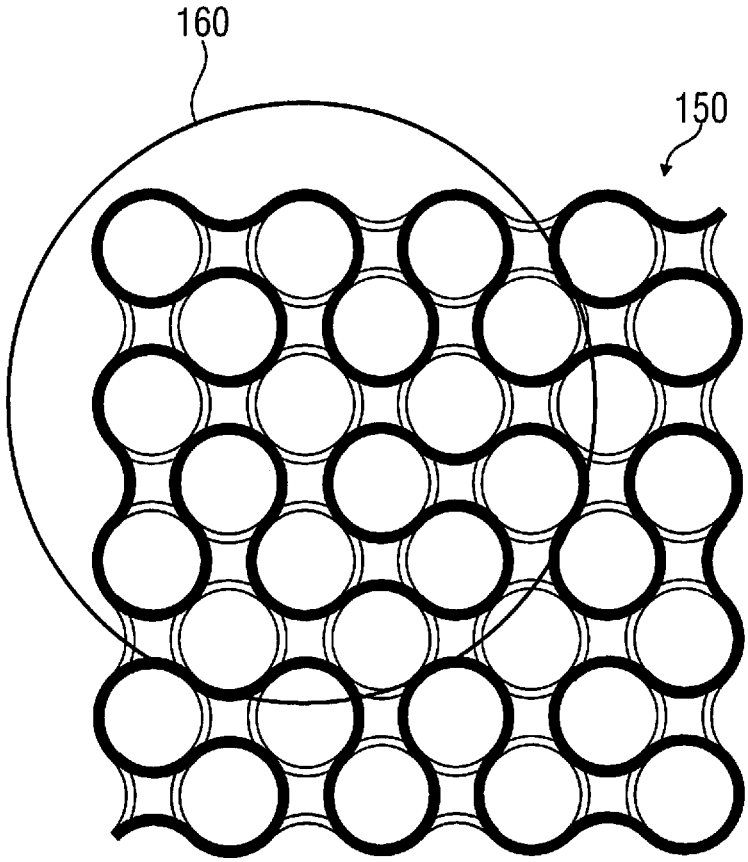
FIG. 1*b* shows an arch-shaped variation of the shape of a second-iteration Peano curve.

FIG. 1*a* shows an example of an electric conductive trace 100 with the shape of a portion of a second-iteration Peano curve as is shown in FIG. 1*b* in the shape varied to be arch-shaped. That portion of the Peano curve 150 that is used for the electric conductive trace 100 is marked by the drawn-in circle 160.

By using a shape based on a fractal, long electric conductive traces may be realized while requiring little space. Due to the arch-shaped variation of the shape of the fractal or of a portion of the fractal, reflections or losses at corners or bends, which otherwise would be present, may be clearly reduced or prevented altogether.

The electric conductive trace may comprise copper, aluminum or a different conductive material, for example. Moreover, in addition to that portion which is shaped as an arch-shaped variation of at least of a portion of a fractal, the electric conductive trace 100 may also comprise further portions having different shapes. As is shown in FIG. 1*a*, the electric conductive trace 100 may have open ends with which it may be connected to electric circuits, for example. Alternatively, the electric conductive trace 100 may also form a closed curve and be connected to the closed curve at any points.

In principle, the fractal may be any fractal, and it depends, e.g., on the respective application of the electric conductive trace 100. The fractal property of the curve may be recognized, e.g., by a self-similarity. For example, the fractal may be a Peano curve or a box fractal. For example, serpentine-type Peano curves may be used. By using box fractals or Peano curves (of the serpentine type), a rectangular or square surface area may already be filled from the iteration, whereas with Pòlya curves, only a triangular area is occupied.

Preferential use is made of fractals wherein the number of line segments at least triples between two iteration steps (i.e. in one iteration), which is true for box fractals and Peano curves (of the serpentine type). In other words, the number of line segments modified in one iteration step is set to at least 3, for example. However, with Pólya curves, the number of line segments merely doubles with each iteration step.

In order to realize an electric conductive trace 100 in a manner saving as much space as possible, the fractal may be a space-filling fractal, for example, which in this context may also be referred to as a space-filling curve.

Generally, a space-filling curve is a continuous mapping $f:I\rightarrow\mathbb{R}^2$ from the unit interval I=[0,1] into the Euclidean space $\mathbb{R}^2$, the image f(I) of which fills an area, i.e. has a Jordan measure J(f(I))>0.

Such space-filling curves may be iteratively described by an initiator (starting figure, "base") and a generator (formation specification, "motif"). By repeated (an infinite number of repetitions) application of this formation specification, the space-filling property of the curve described is achieved.

In a practical application, the iteration may be aborted after N stages, as a result of which the curve in accordance with the definition is not yet space-filling. However, by means of the formation specification it is (theoretically) possible to continue the iteration for any length on smaller scale intervals. Therefore, the presence of such a formation specification is decisive for the question whether or not a curve has space-filling properties.

The space-filling property is met by means of this iteration specification (with infinite continuation). However, this does not means that the curve has to have a fractal property, since there is possibly no self-similarity between the iteration stages. It is also possible that only an anisotropic scaling, e.g. in the vertical direction, takes place between the iteration stages.

However, the structures used in accordance with the concept described are fractal curves with the isotropic scaling between the iterations that may be used for exact self-similarity. Said iterations will then also differ from curves having quasi-self-similarity or statistical self-similarity, for example.

"At least a portion of a fractal" is understood to mean that this may also be the entire fractal of a specific iteration. In other words, the portion of the fractal need not be a strict subset of the fractal, but "portion of the fractal" may also be understood to mean the entire fractal. Differently viewed, an entire fractal is anyway also a portion of a fractal of a higher iteration (e.g. an entire third-iteration fractal is a portion of a fourth-iteration fractal).

The portion of the fractal, however, is larger than at least double the first iteration of the fractal since fractals in a first iteration often have very simple structures and since otherwise the advantage of the space-saving routing of lines will not have an effect in the utilization of fractals. The wording "the portion of the fractal is larger than double a first iteration of the fractal" means that the electric conductive trace within the portion of the fractal adapts, more than twice, the shape of the first iteration of the fractal (in its arch-shaped variation). In other words, the portion of the fractal contains (the shape of) the fractal in the first iteration more than twice.

Figure 1C:
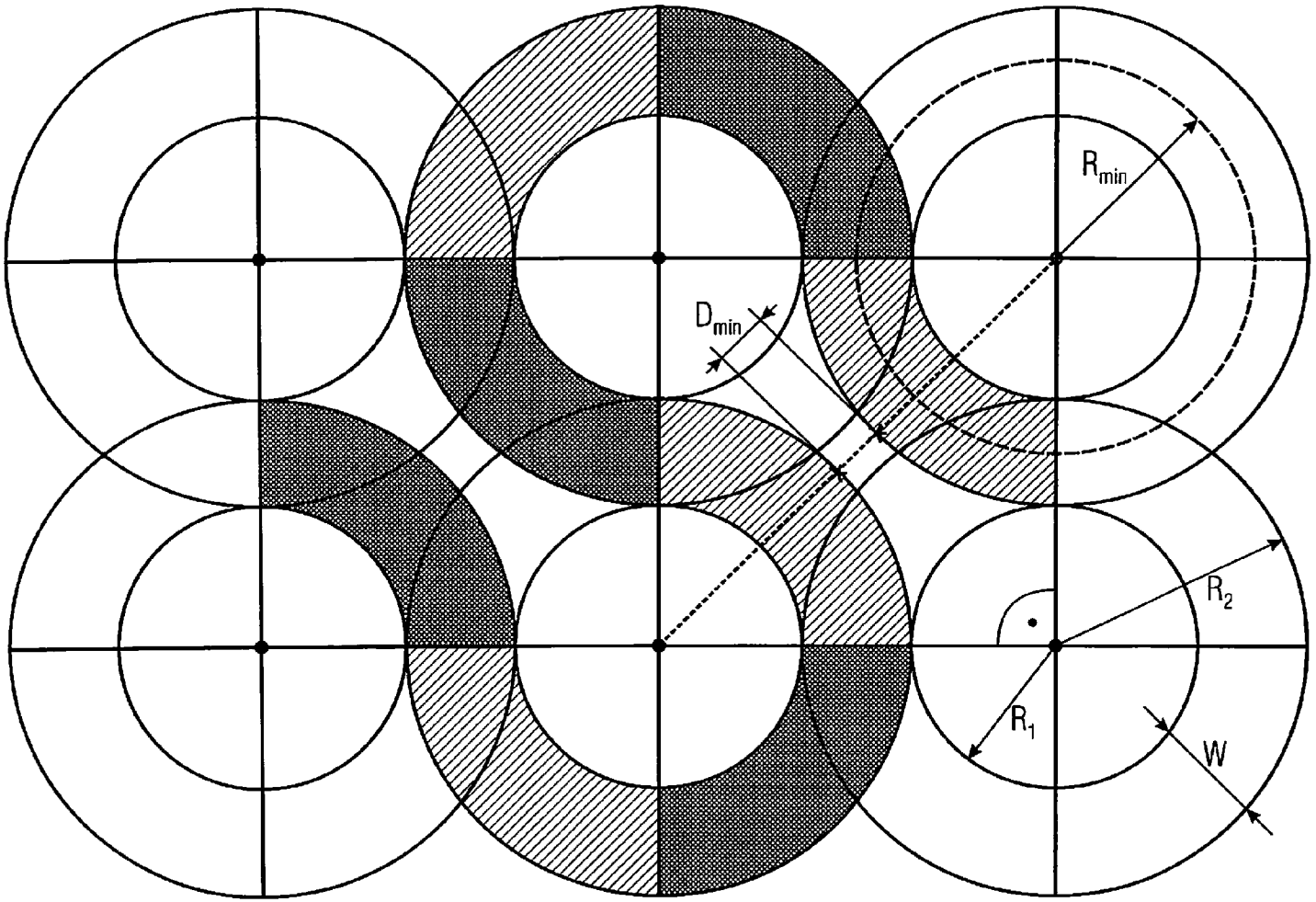
FIG. 1*c* shows a schematic representation of a possible definition for the predefined minimum curve radius.

Many fractals have an angular shape in their know representation. As compared to said known shapes of fractals, the shape varied to be arch-shaped has a predefined minimum curve radius $R_{min}$ for changes of direction of the electric conductive trace, which minimum curve radius $R_{min}$ is not fallen below. In this context, the predefined minimum curve radius amounts, e.g., to at least triple (or the same as, 1.5 times, double, quadruple or more) the width of the electric conductive trace 100. Alternatively, the predefined minimum curve radius may be determined in accordance with $$R_{min} = \frac{W}{2(\sqrt{2}-1)} + \frac{D_{min}}{2},$$

wherein W is the width of the electric conductive trace and $D_{min}$ is a minimum distance between two rings of a raster that are arranged in the corner points of a square and are diagonally arranged toward one another, as is shown in FIG. 1*c* and will be described in more detail below.

The curve radius of a change of direction of the electric conductive trace relates, e.g., to the internal radius, the central radius or the external radius of the electric conductive trace in the corresponding phase of the change of direction.

Generally, for example, a length of the electric conductive trace 100 is longer than 10 times (or 20×, 50×, 100× or more) a width of the electric conductive trace 100 and longer than 10 times (20×, 50×, 100× or more) a height of the electric conductive trace. The electric conductive trace 100 adopts, in its longitudinal extension (direction of its largest extension) the shape varied to be arch-shaped.

The electric conductive trace 100 may have a constant width (or height) over its length, or, alternatively, have different widths (or heights) in different portions. This may differ, depending on the requirement made by the specific application.

Normally, the electric conductive trace 100 lies within a plane, so that the shape varied to be arch-shaped will be easily visible. This is meant to say that in its longitudinal extension and its latitudinal extension, the electric conductive trace extends within the plane. However, it is also possible for a three-dimensional structure to be formed by the electric conductive trace 100, so that portions of the electric conductive trace 100 may lie within different planes.

The electric conductive trace 100 may also comprise several instances of an arch-shaped variation of a shape of at least a portion of a fractal of at least a second iteration. These may be portions of the same fractal or may be different fractals. To achieve a large space-saving effect, it may be specified, for example, that the electric conductive trace 100 comprises one or several instances of an arch-shaped variation of a shape of at least a portion of a fractal of at least a second iteration over at least 50% (or 20%, 30%, 70%, 80% or more) of its length.

In some embodiments in accordance with the invention, the electric conductive trace has a shape varied to be arch-shaped and comprising exclusively changes of direction having the same curve radius (which is larger than the predefined minimum curve radius). This may also relate to the entire electric conductive trace if same is larger than that portion which corresponds to a shape, varied to be arch-shaped, of at least a portion of a fractal of at least a second iteration.

One possibility of designing such structures is to adapt the electric conductive trace to a raster consisting of ring-shaped segments. In other words, the shape varied to be arch-shaped fits, e.g., onto a raster of ring-shaped segments (e.g. FIG. 1*c*) arranged at a distance of their mean diameter. The mean diameter of the ring-shaped segment is the average value of the internal diameter ($2*R_1$) and of the external diameter ($2*R_2$) of the ring-shaped segment. The ring-shaped segments of the raster are equal in size.

Some embodiments in accordance with the invention relate to an antenna, a line or a distributed circuit comprising an electric conductive trace in accordance with the concept described.

In this manner, an antenna or, e.g., a delay line may be realized in a very space-saving and low-reflection and/or low-loss manner.

Some other embodiments in accordance with the invention relate to a method of producing an electric conductive trace, the electric conductive trace being produced with the shape described (on a substrate).

Some embodiments in accordance with the invention relate to antennas, lines and/or distributed circuits while utilizing space-filling curves and fractals that are modified to rounding grids (rasters having ring-shaped segments) (arch-shaped variation of the shape). In this context, electric conductive traces in accordance with the concept described are applied.

The distributed circuits may be radio-frequency circuits, for example. In other words, the antennas, lines and/or passive radio-frequency circuits may be designed by using modified space-filling curves and (or) fractals.

Figure 4:
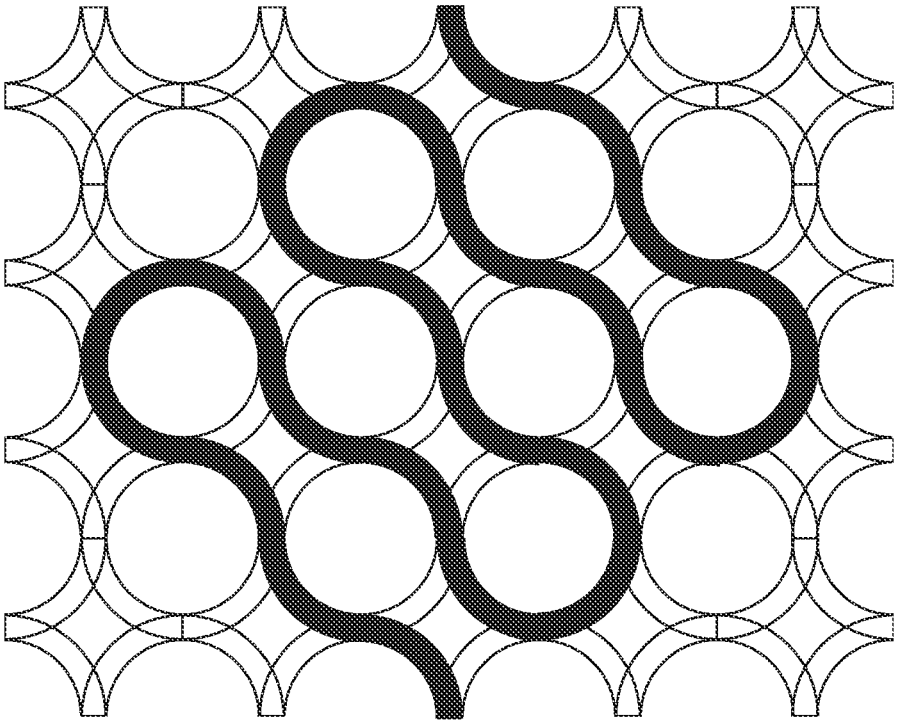
FIGURE 4 (PRIOR ART)
FIG. 4 shows an example of a known convolution of a straight conductive lead (line)
Figure 5:
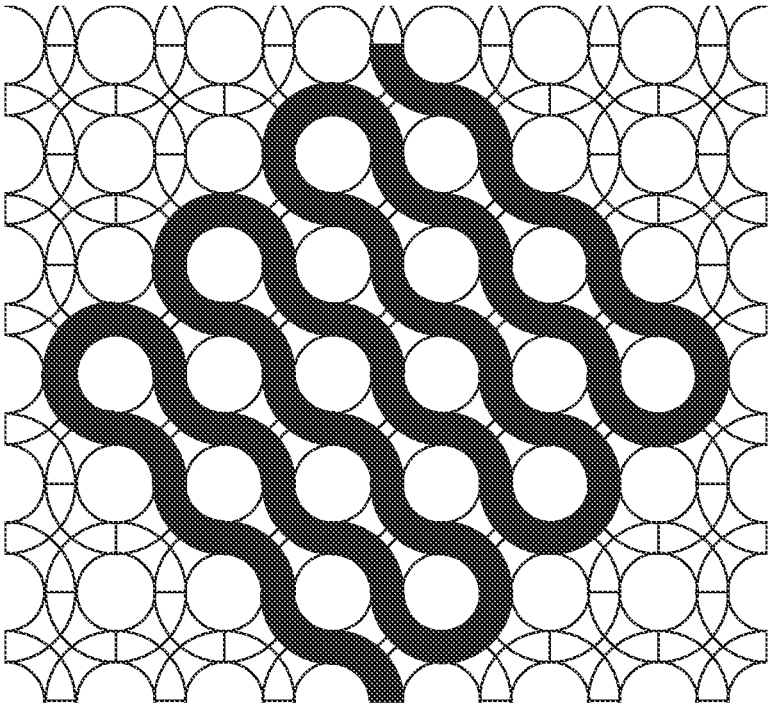
FIGURE 5 (PRIOR ART)
FIG. 5 shows a further example of a known convolution of a straight conductive lead.
Figure 6:
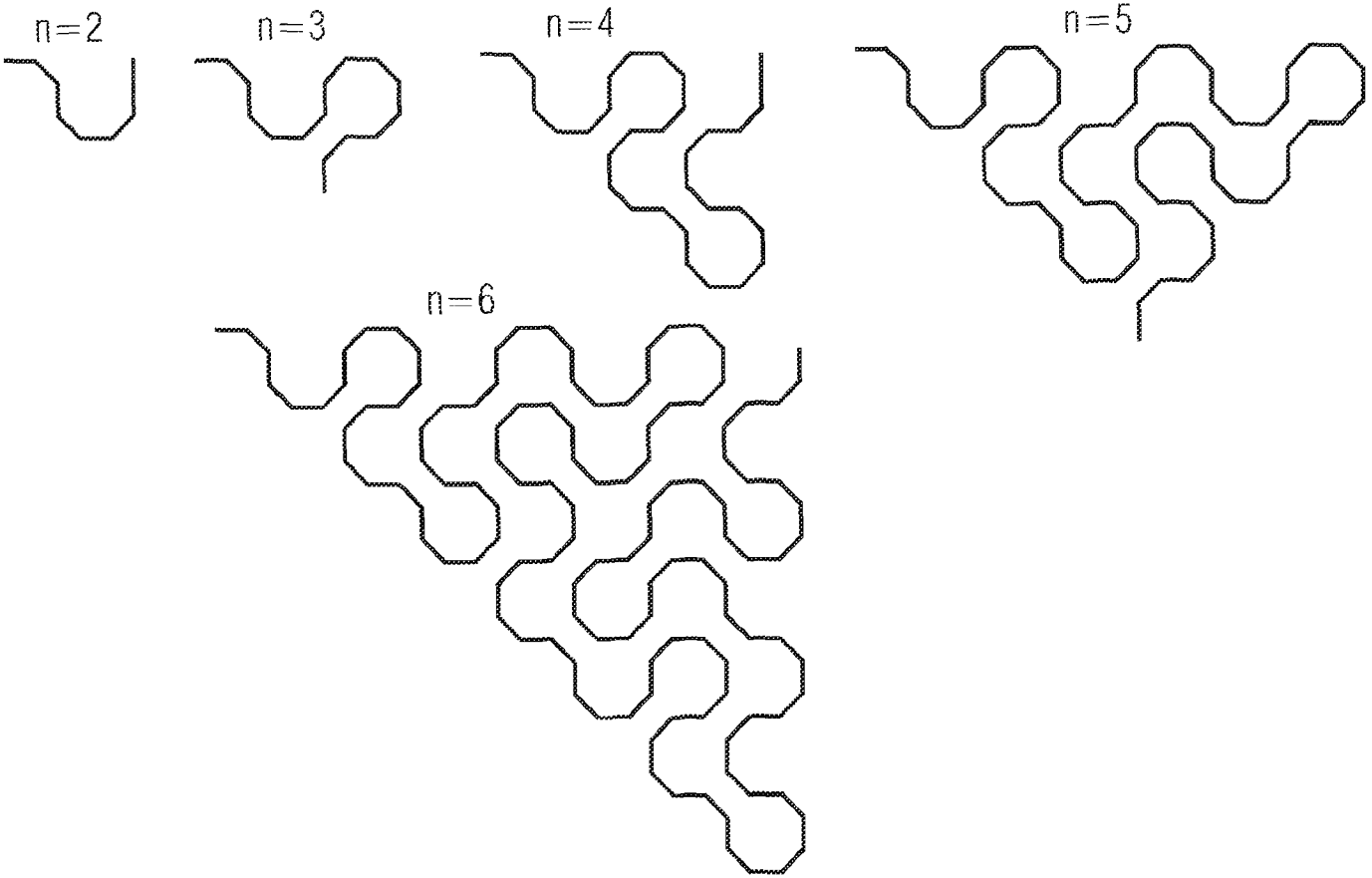
FIGURE 6 (PRIOR ART)
FIG. 6 shows a modified polygon-shaped second-to-sixth-iteration Polya curve.

In known circuits or antennas, lines are routed such that bends occur. If the resulting bends are not tapered, the transmission characteristics of the line are disturbed, which results in additional losses. What is lowest in loss is a (double-sidedly) arch-shaped transition; the bending radius should amount to, e.g., at least triple the conductor width. This is due to the fact that the characteristic impedance of the arch clearly changes, and presents a discontinuity, as the radius falls short of the above-mentioned value. In Popugaev, A. E.; Wansch, R. "A Novel Miniaturization Technique in Microstrip Feed Network Design", 3rd European Conference on Antennas and Propagation (EuCAP 2009), Proceedings, CD-ROM: 23-27 Mar. 2009, Berlin, Germany, Berlin: VDE-Verlag, 2009, pp. 2309-2313, it was shown that circuits to be miniaturized may be configured to be fully arch-shaped so that no discontinuities of the type straight conductive lead/arch will result. As an auxiliary tool one may use a raster consisting of ring-shaped segments arranged at the distance of their mean diameter, each segment being subdivided into four equal quadrant rings. Several line-routing curves are depicted which are aligned on a rounding grid, but which are not fractals or space-filling curves; also, no iteration specification is indicated. These curves are freehand curves; an iteration specification for the transition to the next scale stage down is neither indicated nor recognizable. The curves shown are therefore not space-filling curves. FIGS. 4 and 5 illustrate such a raster for convoluting straight conductive leads.

For example, a delay line may be effectively miniaturized while using round segments for fractals.

The concept proposed enables, e.g., the design of fractal antennas and circuits based on a Peano curve which was modified such that no bends occur. As a result, optimum transmission properties with regard to reflections may be ensured, for example, in particular with microstrip line circuits.

Figure 7:
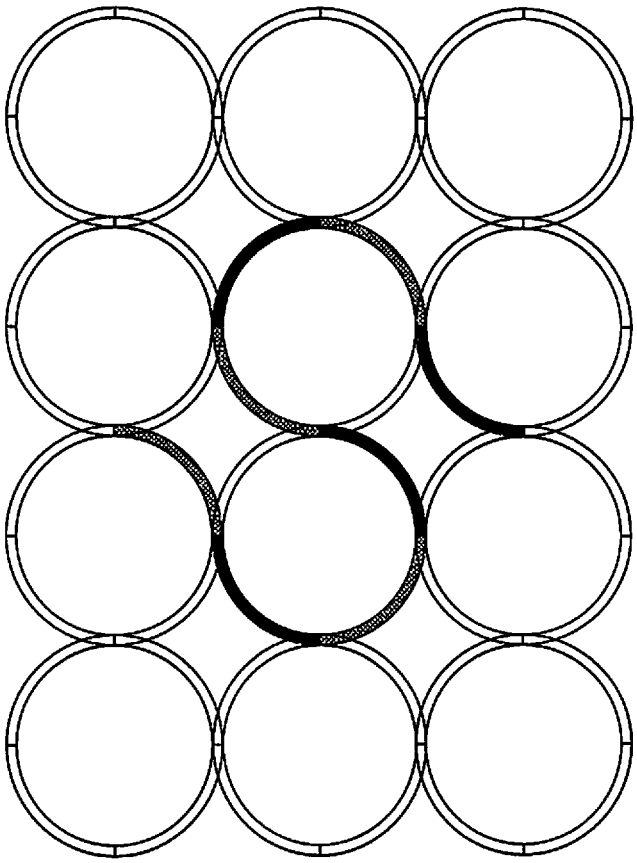
FIG. 7 shows an approximation of a first-iteration Peano curve through arch-shaped segments.
Figure 8A:
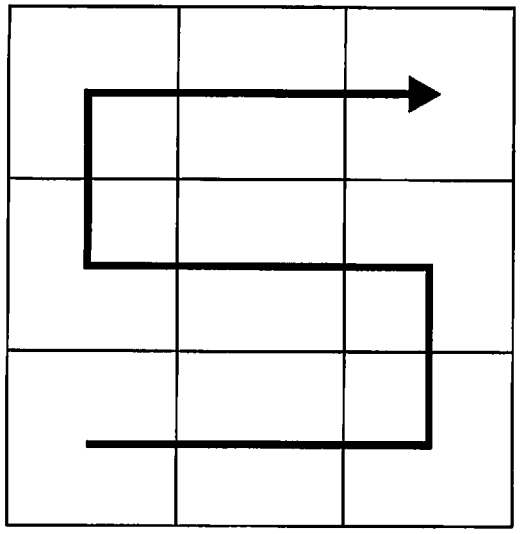
FIG. 8*a* shows a first-iteration Peano curve.
Figure 8B:
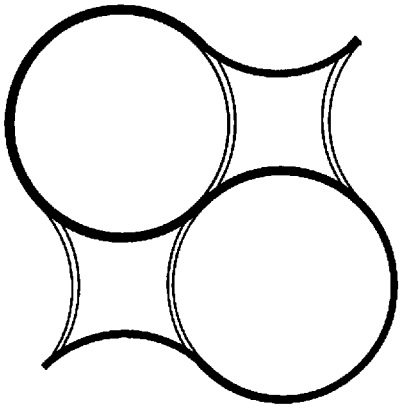
FIG. 8*b* shows a modified first-iteration Peano curve.

For a Peano curve modified on a rounding grid it will turn out, for example, when taking the raster in accordance with FIGS. 4 and 5 and drawing the curve shown in FIG. 7 and rotating the curve having the raster by 45°, one may find that said curve is very similar to the $1^{st}$-iteration Peano curve, as is shown in FIGS. 8*a* and 8*b*. FIG. 8*a* shows a first-iteration Peano curve, and FIG. 8*b* shows a modified first-iteration Peano curve. The modified curve may be seen as an approximation of the Peano curve through arch-shaped segments.

Figure 9A:
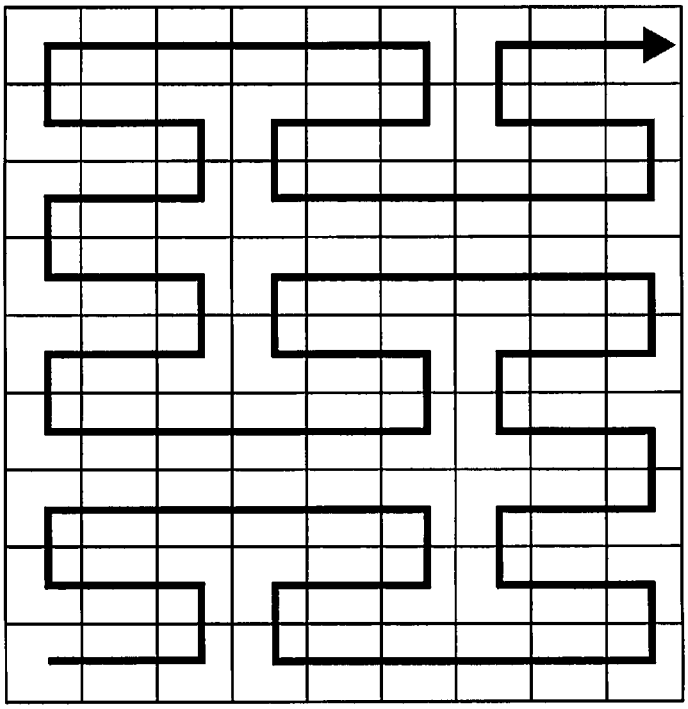
FIG. 9*a* shows a second-iteration Peano curve of a 000 000 000 type of serpentine.
Figure 9B:
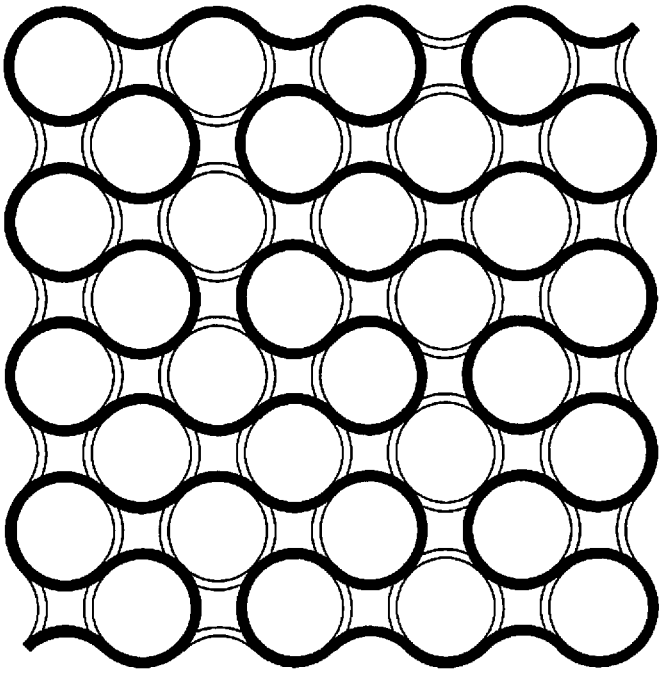
FIG. 9*b* shows a modified second-iteration Peano curve of a 000 000 000 type of serpentine.
Figure 10A:
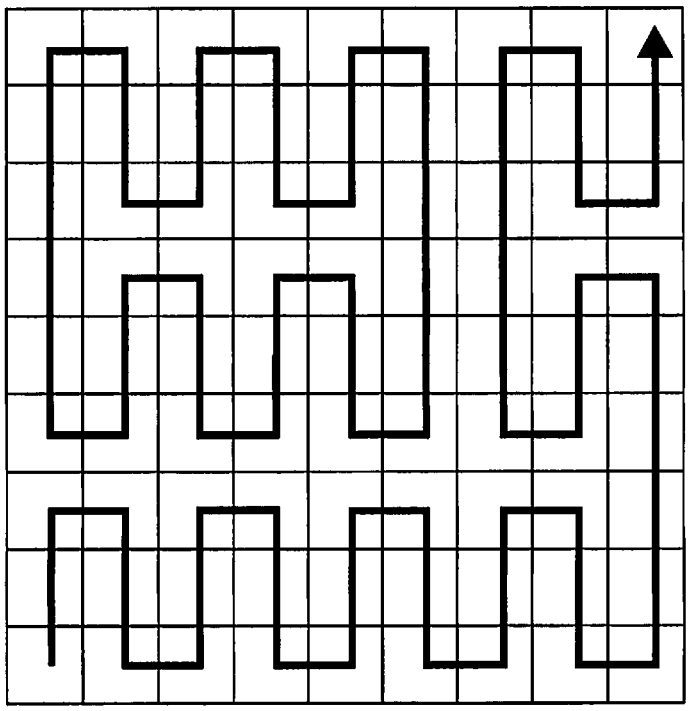
FIG. 10*a* shows a second-iteration Peano curve of a 111 111 111 type of serpentine.
Figure 10B:
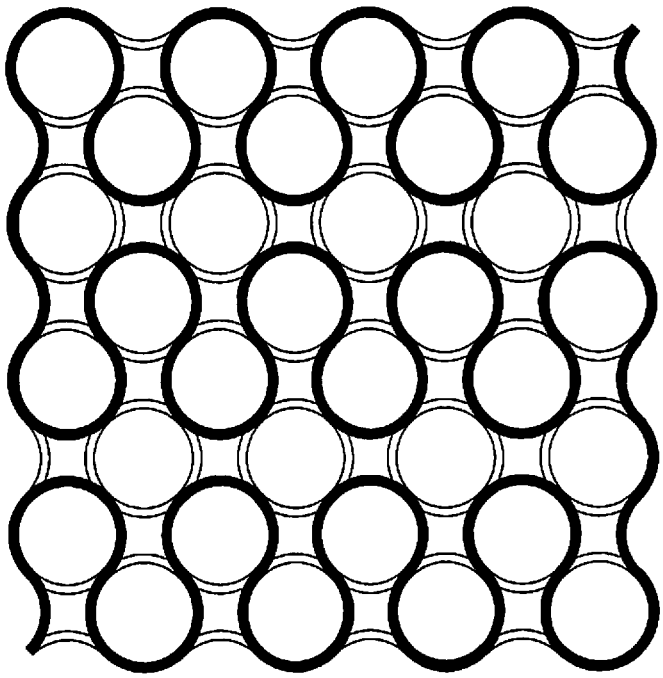
FIG. 10*b* shows a modified second-iteration Peano curve of a 111 111 111 type of serpentine.
Figure 11A:
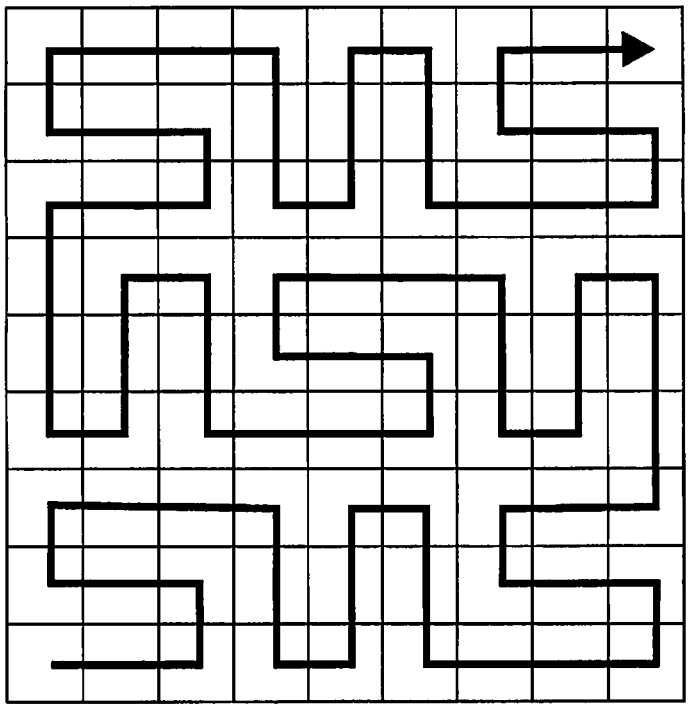
FIG. 11*a* shows a second-iteration Peano curve of a 010 101 010 type of serpentine.
Figure 11B:
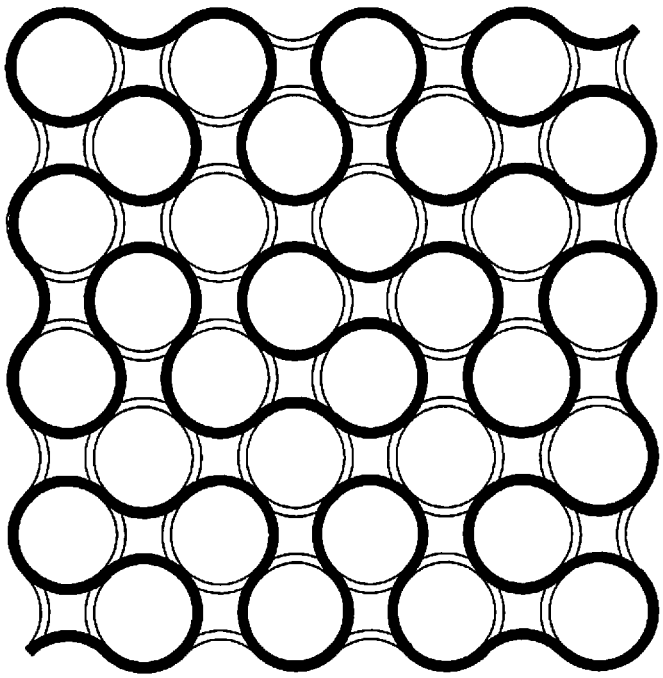
FIG. 11*b* shows a modified second-iteration Peano curve of a 010 101 010 type of serpentine.

By means of a continued re-division of the modified $1^{st}$-iteration Peano curve shown in FIGS. 8*a* and 8*b*, modified serpentine-type Peano curves may also be obtained. FIG. 9A (second-iteration Peano curve of a 000 000 000 type of serpentine) and 9B (modified second-iteration Peano curve of a 000 000 000 type of serpentine), FIG. 10A (second-iteration Peano curve of a 111 111 111 type of serpentine, FIG. 10B (modified second-iteration Peano curve of a 111 111 111 type of serpentine), FIG. 11A (second-iteration Peano curve of a 010 101 010 type of serpentine) and FIG. 11B (modified second-iteration Peano curve of a 010 101 010 type of serpentine) show $2^{nd}$ iterations of the three different variants.

Figure 2:
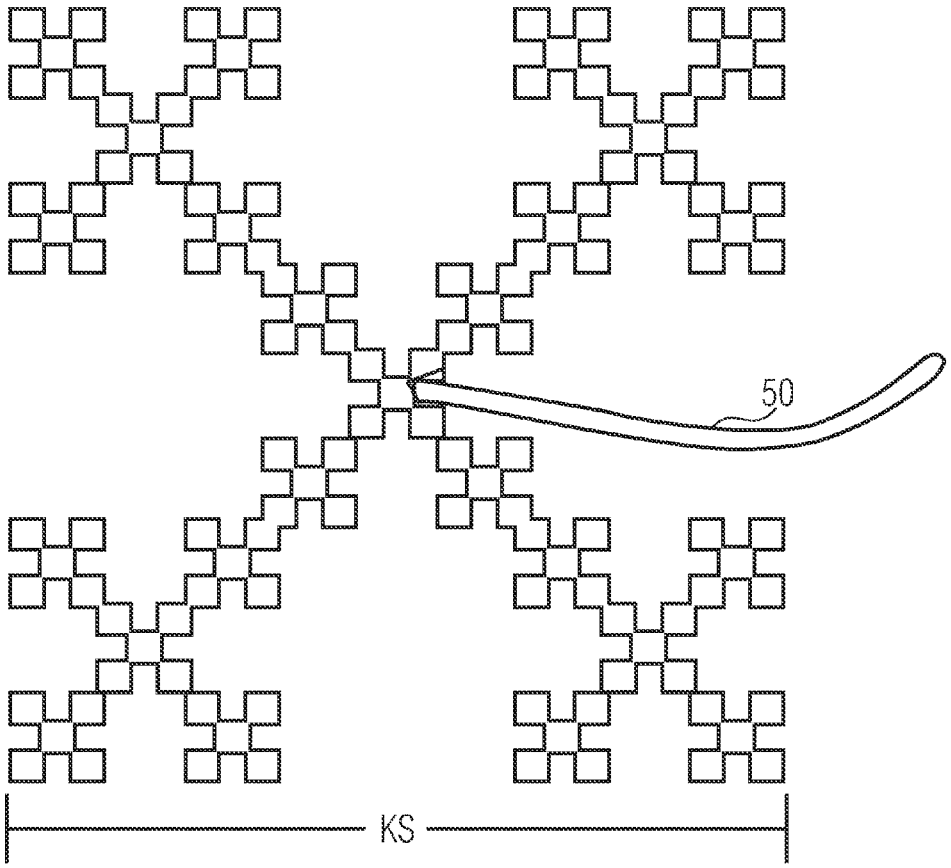
FIGURE 2 (PRIOR ART)
FIG. 2 shows a known fractal antenna.
Figure 3:
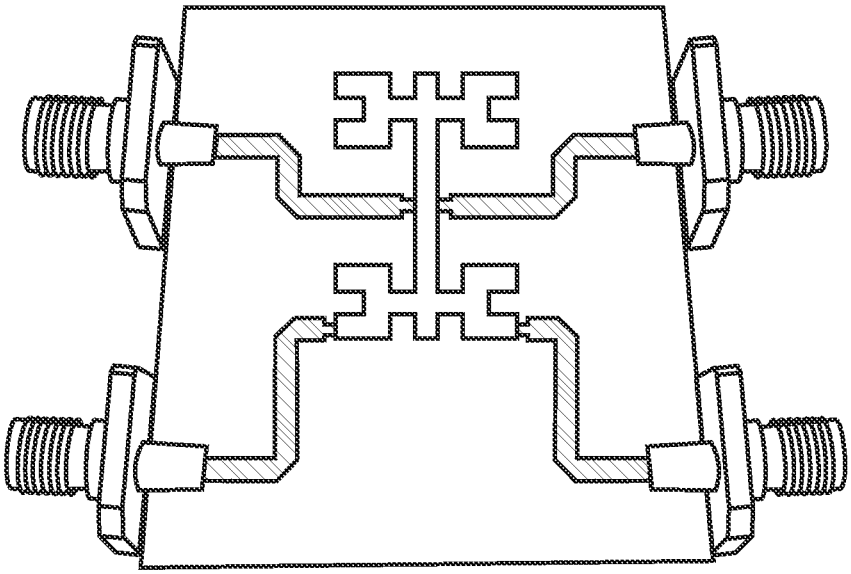
FIGURE 3 (PRIOR ART)
FIG. 3 shows a known rat-race hybrid.
Figure 12A:
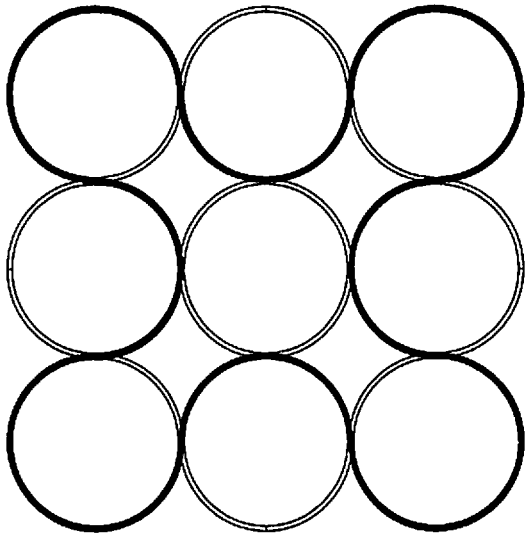
FIG. 12*a* shows a modified first-iteration box fractal.
Figure 12B:
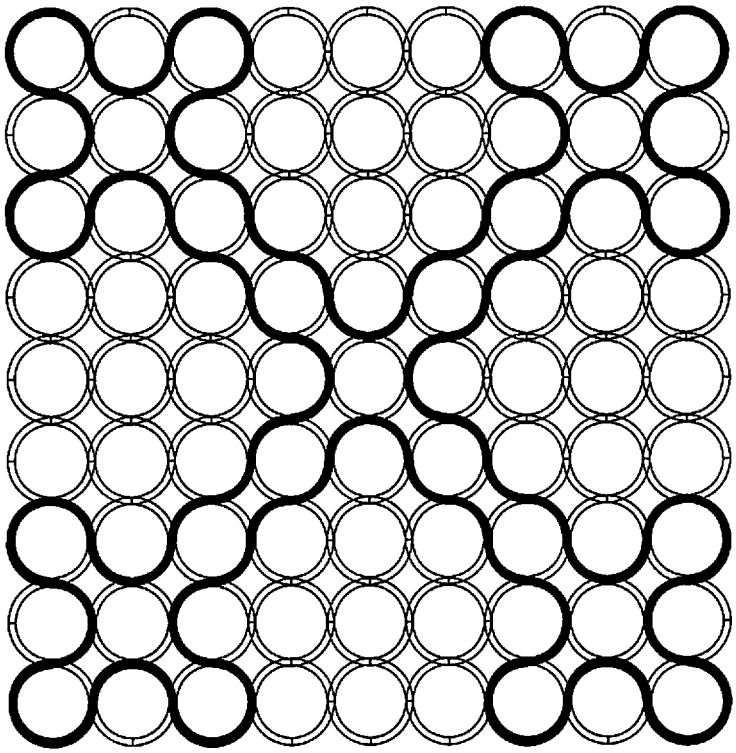
FIG. 12*b* shows a modified second-iteration box fractal.
Figure 12C:
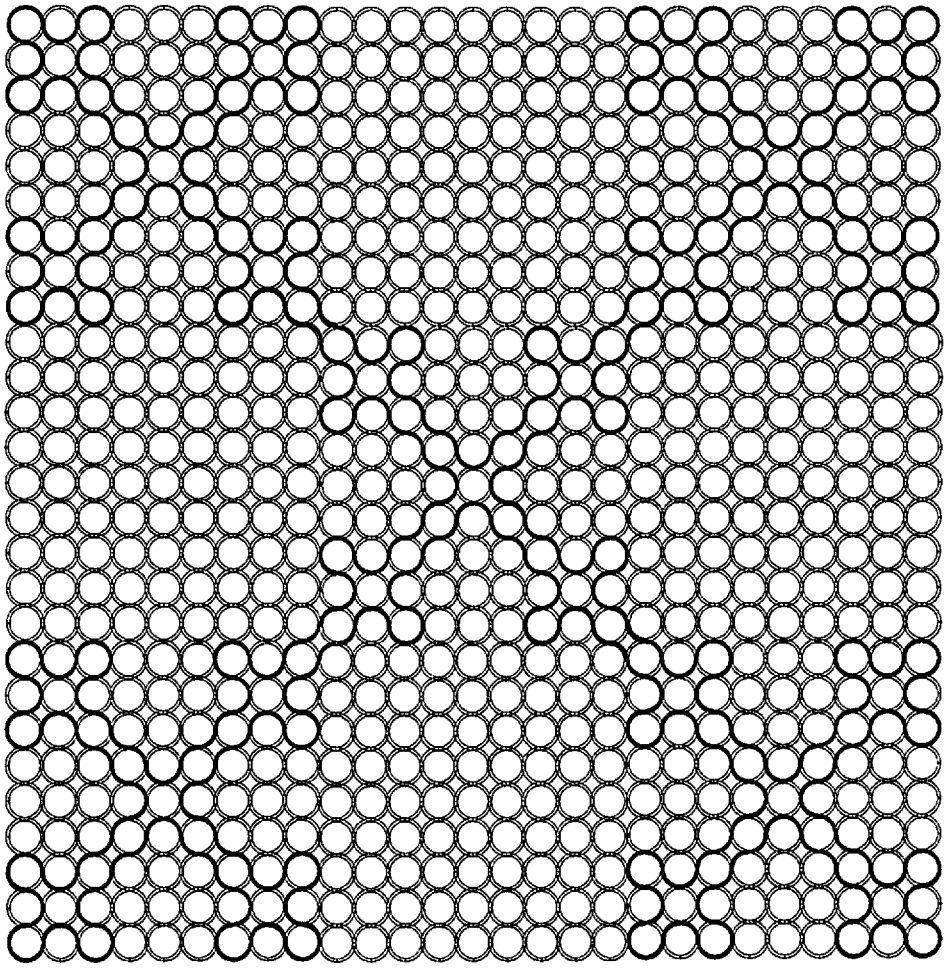
FIG. 12*c* shows a modified third-iteration box fractal.

Alternatively, a box fractal (Vicsek fractal, Minkowski island) modified to rounding grids may be used, for example. The fractal antenna shown in FIG. 2 may also be modified on a rounding grid. The first three iterations are illustrated in FIGS. 12A-12C.

Figure 13A:
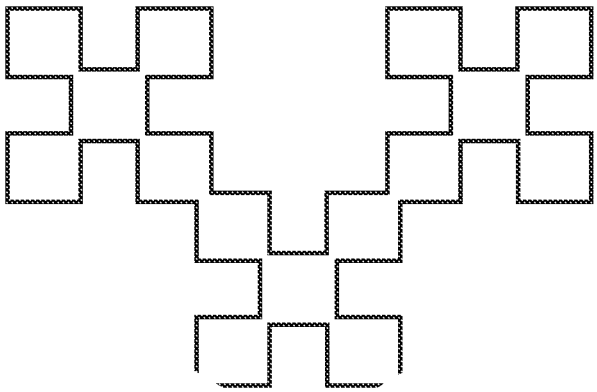
FIGURE 13A (PRIOR ART)
FIG. 13*a* shows a box fractal with contactless routing through shortened lines.
Figure 13B:
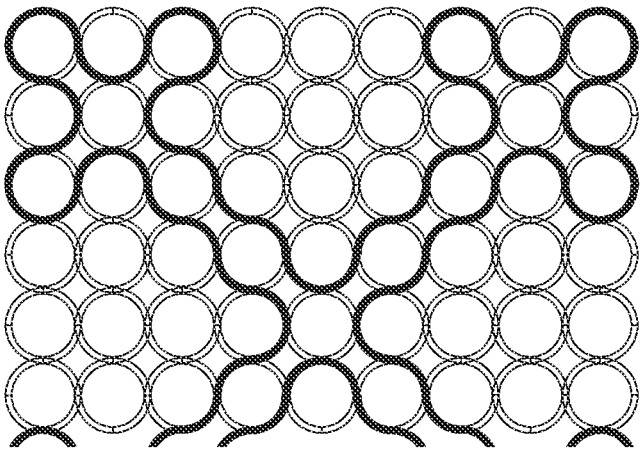
FIG. 13*b* shows a box fractal with contactless routing through alignment to rounding grids.

By using the technology described (the concept described for electric conductive traces), antennas, lines and/or complex circuits may be built which exploit the advantages of fractal structures but may be realized in a simpler and faster manner and/or, above all, with less reflection and/or loss. Due to the alignment on a rounding grid, contactless line routing may be realized without having to manually shorten line sections of the original fractal structure (FIGS. 13A and 13B).

For example, a Butler matrix has been developed for a 2×2 antenna arrangement, and has subsequently been miniaturized. The circuit is meant to realize uniform amplitude allocation and the following phase allocations (depending on the combination of ports): −180°/−90°/−180°/−270°; −90°/−180°/−270°/−180°; −180°/−270°/−180°/−90° and −270°/−180°/−90°/−180°.

Figure 14B:
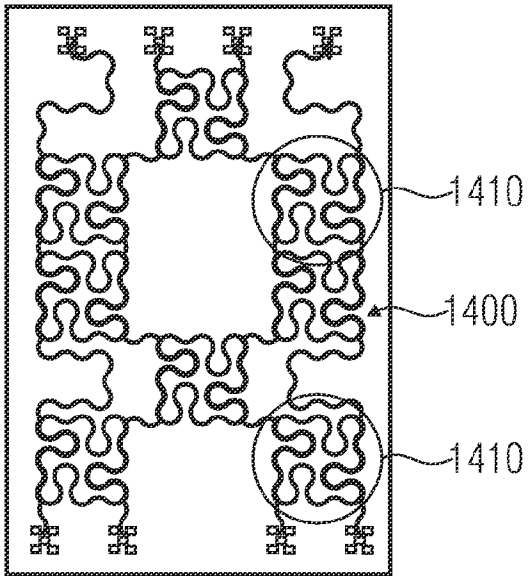
FIG. 14*b* shows a miniaturized Butler matrix.
Figure 14A:
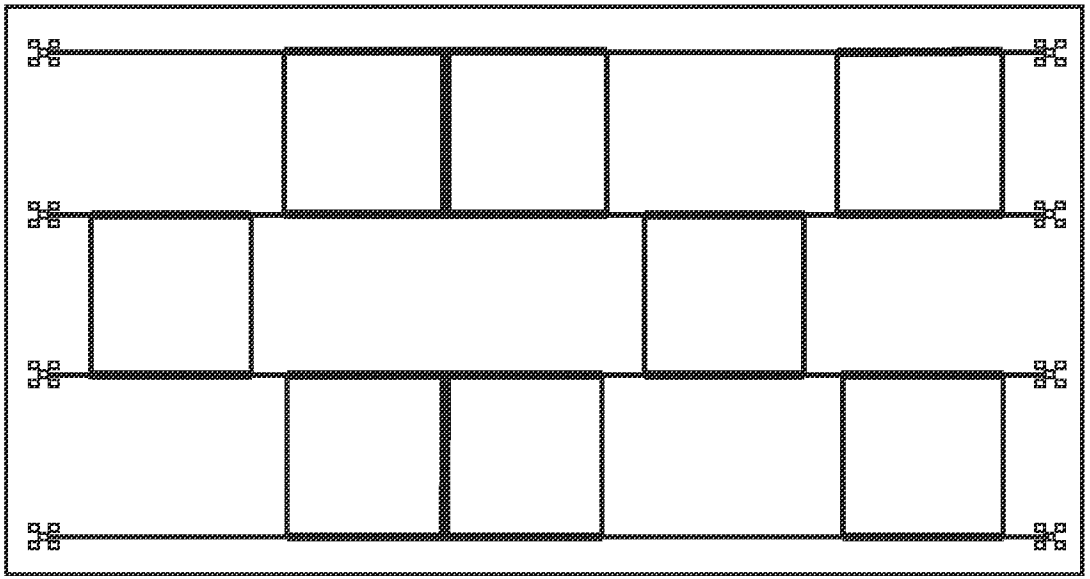
FIGURE 14A (PRIOR ART)
FIG. 14*a* shows a conventional Butler matrix.

A direct comparison of the built Butler matrices may be seen in FIGS. 14*a* and 14*b*. FIG. 14*b* shows an electric conductive trace 1400 with several instances of an arch-shaped variation of a shape of at least a portion 1410 of a fractal of at least a second iteration.

The electric conductive traces shown in FIGS. 14*a* and 14*b* have different widths in different sections.

One can see that the miniaturized supply network (in FIG. 14*b*) is almost three times as small as the conventional configuration (FIG. 14*a*). The circuits comprise 90° hybrids, cross-couplers and delay lines. The miniaturized cross-coupler has been configured as two miniaturized 90° hybrids connected in series, each miniaturized 90° hybrid representing (a portion of) the modified Peano curve of FIG. 11*b*. Measurement results of the Butler matrix established are summarized in the following table.

| | | Butler matrix produced | | | |
|---|---|---|---|---|---|
| | | Conventional | | Miniaturized | |
| Input port (j) | Output port (i) | \|Sij\| [dB] | arg(Sij) [deg] | \|Sij\| [dB] | arg(Sij) [deg] |
| 1 | 5 | −6.9 − 0.1 | −270 − 0.2 | −6.95 − 0.25 | −270 + 1.75 |
| | 6 | −6.9 + 0.0 | −180 − 0.0 | −6.95 + 0.25 | −180 + 0.45 |
| | 7 | −6.9 + 0.0 | −270 − 0.1 | −6.95 + 0.05 | −270 + 1.55 |
| | 8 | −6.9 + 0.0 | 0 + 0.6 | −6.95 − 0.05 | 0 + 1.65 |
| 2 | 5 | −6.9 − 0.1 | −180 − 0.5 | −6.95 + 0.05 | −180 − 1.45 |
| | 6 | −6.9 + 0.0 | −270 − 0.6 | −6.95 + 0.05 | −270 − 0.75 |
| | 7 | −6.9 − 0.1 | 0 + 0.3 | −6.95 − 0.35 | 0 − 0.65 |
| | 8 | −6.9 + 0.1 | −270 + 0.3 | −6.95 + 0.25 | −270 + 0.95 |
| 3 | 5 | −6.9 + 0.1 | −270 − 0.4 | −6.95 + 0.15 | −270 − 0.45 |
| | 6 | −6.9 − 0.0 | 0 − 0.1 | −6.95 − 0.35 | 0 − 1.75 |
| | 7 | −6.9 − 0.0 | −270 + 0.1 | −6.95 − 0.05 | −270 + 0.25 |
| | 8 | −6.9 − 0.0 | −180 + 0.1 | −6.95 + 0.15 | −180 − 0.75 |
| 4 | 5 | −6.9 + 0.1 | 0 + 0.3 | −6.95 − 0.05 | 0 + 0.05 |
| | 6 | −6.9 − 0.0 | −270 − 0.1 | −6.95 − 0.05 | −270 + 0.55 |
| | 7 | −6.9 + 0.1 | −180 + 0.2 | −6.95 + 0.35 | −180 + 0.65 |
| | 8 | −6.9 − 0.1 | −270 − 0.2 | −6.95 − 0.35 | −270 + 1.55 |
| abs. error: | | ±0.1 | ±0.2 | ±0.35 | ±1.75 |

The results achieved of the conventional and miniaturized Butler matrices are almost identical, the space requirement of the miniaturized Butler matrix amounting to one third only.

Some embodiments in accordance with the invention relate to antennas, lines and/or distributed circuits produced while using space-filling curves with fractal structures, the fractal structure comprising accurate self-similarity or scale invariance, at least one iteration stage having been performed, or one or more sections of such a fractal curve having been used, and the resulting curve having been modified by means of a rounding grid such that contactless and non-bent line routing is achieved, so that line sections of the original fractal structure need not be manually shortened in order to achieve contactless routing, whereby—as compared to the conventional configuration—clearly simplified line routing is enabled, and optimum transmission properties with regard to reflections may be ensured.

Even though some aspects have been described within the context of a device, it is understood that said aspects also represent a description of the corresponding method, so that a block or a structural component of a device is also to be understood as a corresponding method step or as a feature of a method step. By analogy therewith, aspects that have been described in connection with or as a method step also represent a description of a corresponding block or detail or feature of a corresponding device. Some or all of the method steps may be performed while using a hardware device, such as a microprocessor, a programmable computer or an electronic circuit. In some embodiments, some or several of the most important method steps may be performed by such a device.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An electric conductive trace comprising an arch-shaped variation of a shape of at least a portion of a fractal of at least a second iteration, the portion of the fractal being larger than double of a first iteration of the fractal, the shape varied to be arch-shaped comprising, for changes of direction, a curve radius larger than a predefined minimum curve radius, wherein the predefined minimum curve radius of the arch-shaped variation is equal to $$R_{min} = \frac{W}{2(\sqrt{2}-1)} + \frac{D_{min}}{2},$$

wherein W is the width of the electric conductive trace and $D_{min}$ is a minimum distance between two rings of a raster that are arranged in the corner points of a square and are diagonally arranged toward one another.

2. The electric conductive trace as claimed in claim 1, wherein the fractal is a Peano curve or a box fractal.

3. The electric conductive trace as claimed in claim 1, wherein the fractal is a space-filling fractal.

4. The electric conductive trace as claimed in claim 1, wherein the electric conductive trace lies within a plane.

5. The electric conductive trace as claimed in claim 1, wherein a length of the electric conductive trace is larger than 10 times a width of the electric conductive trace and larger than 10 times a height of the electric conductive trace, the electric conductive trace comprising, in its longitudinal extension, the shape varied to be arch-shaped.

6. The electric conductive trace as claimed in claim 1, wherein the shape varied to be arch-shaped comprises exclusively changes of direction comprising the same curve radius.

7. The electric conductive trace as claimed in claim 1, wherein the shape varied to be arch-shaped fits onto a raster of ring-shaped segments arranged at a distance of the mean diameter of the ring-shaped segments, the mean diameter being the average value of the internal diameter and of the external diameter of the ring-shaped segments.

8. The electric conductive trace as claimed in claim 1, the electric conductive trace comprising several instances of an arch-shaped variation of a shape of at least a portion of a fractal of at least a second iteration.

9. The electric conductive trace as claimed in claim 1, wherein the electric conductive trace comprises, over at least 50% of its length, one or several instances of an arch-shaped variation of a shape of at least a portion of a fractal of at least a second iteration.

10. An antenna, line or distributed circuit comprising an electric conductive trace comprising an arch-shaped variation of a shape of at least a portion of a fractal of at least a second iteration, the portion of the fractal being larger than double of a first iteration of the fractal, the shape varied to be arch-shaped comprising, for changes of direction, a curve radius larger than a predefined minimum curve radius, wherein the predefined minimum curve radius of the arch-shaped variation is equal to $$R_{min} = \frac{W}{2(\sqrt{2}-1)} + \frac{D_{min}}{2},$$

wherein W is the width of the electric conductive trace and $D_{min}$ is a minimum distance between two rings of a raster that are arranged in the corner points of a square and are diagonally arranged toward one another.

* * * * *

UNITED STATES PATENT AND TRADEMARK OFFICE

CERTIFICATE OF CORRECTION

PATENT NO. : 8,878,729 B2
APPLICATION NO. : 13/441433
DATED : November 4, 2014
INVENTOR(S) : Alexander Popugaev et al.

It is certified that error appears in the above-identified patent and that said Letters Patent is hereby corrected as shown below:

In the claims

In claim 1, Column 8 and in claim 10, column 9:

$$R_{min} = \frac{W}{2(\sqrt{2}-1)} + \frac{D_{min}}{2}$$

should read:

$$R_{min} = \frac{W}{2(\sqrt{2}-1)} + \frac{D_{min}}{2(\sqrt{2}-1)}$$

Signed and Sealed this
First Day of December, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,878,729 B2
APPLICATION NO. : 13/441433
DATED : November 4, 2014
INVENTOR(S) : Alexander Popugaev et al.

It is certified that error appears in the above-identified patent and that said Letters Patent is hereby corrected as shown below:

On the Title Page

Item (73) Assignee: "Fraunhofer-Gesellschaft zur Foerderung Angewandten Forschung E.V." should read -- Fraunhofer-Gesellschaft zur Foerderung angewandten Forschung e.V. --.

Signed and Sealed this
Seventh Day of March, 2017

Michelle K. Lee

Michelle K. Lee
*Director of the United States Patent and Trademark Office*